US010810828B2

(12) United States Patent
Reynolds et al.

(10) Patent No.: US 10,810,828 B2
(45) Date of Patent: Oct. 20, 2020

(54) INTERACTIVE ELECTRONIC REEL GAMING MACHINE WITH A SPECIAL REGION

(71) Applicant: Aristocrat Technologies Australia Pty Limited, North Ryde (AU)

(72) Inventors: Christopher Reynolds, Las Vegas, NV (US); Damien Burczyk, Henderson, NV (US); Adam Pippin, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 36 days.

(21) Appl. No.: 16/059,878

(22) Filed: Aug. 9, 2018

(65) Prior Publication Data

US 2019/0073860 A1 Mar. 7, 2019

Related U.S. Application Data

(60) Provisional application No. 62/553,980, filed on Sep. 4, 2017.

(51) Int. Cl.
*G07F 17/32* (2006.01)

(52) U.S. Cl.
CPC ..... *G07F 17/3213* (2013.01); *G07F 17/3209* (2013.01); *G07F 17/3244* (2013.01)

(58) Field of Classification Search
CPC ..... G07F 17/3213; G07F 17/3244; G07F 17/3209
USPC ..... 463/16–20
See application file for complete search history.

(56) References Cited

U.S. PATENT DOCUMENTS

| | | | |
|---|---|---|---|
| D71,485 | S | 11/1926 | Uhl |
| D78,445 | S | 5/1929 | Cneesh |
| D131,497 | S | 12/1941 | Schwarber |
| D168,937 | S | 3/1953 | Hulcher |
| D172,830 | S | 8/1954 | Hebert |
| D197,654 | S | 3/1964 | Ward |
| 5,223,701 | A | 6/1993 | Batterman |

(Continued)

OTHER PUBLICATIONS

BestOnLineCasinos.com, "Elvira, Mistress of the Dark Slots Machine", last accessed Nov. 9, 2018, 7 pages.

(Continued)

*Primary Examiner* — Michael A Cuff
(74) *Attorney, Agent, or Firm* — McAndrews, Held & Malloy, Ltd.

(57) ABSTRACT

An interactive electronic reel gaming machine that includes a special region is disclosed. A game controller is configured to provide a reel with a particular arrangement of display positions, where each display position includes a separately controlled individual reel. Following receipt of a user input, one or more of the individual reels are spun and stopped, displaying symbols (e.g., corresponding to playing cards, pictures, credit values, etc.) in one or more of the display positions. The game controller is configured to apply a multiplier to symbols displayed in the special region. Pay awards are made when clusters of two or more like symbols are located in adjacent display positions. The pay award is increased if one or more symbols of the cluster is located in a display position corresponding to the special region. The symbol display positions are configured in a geometric shape.

16 Claims, 18 Drawing Sheets

(56) References Cited

U.S. PATENT DOCUMENTS

| | | | | |
|---|---|---|---|---|
| D37,745 | S | 12/2005 | Black | |
| D661,909 | S | 6/2012 | Zhyhaylo | |
| D682,358 | S | 5/2013 | Scollin | |
| D685,859 | S | 7/2013 | Weitman | |
| D713,852 | S | 9/2014 | Glezer | |
| D734,779 | S | 7/2015 | Dye | |
| D738,399 | S | 9/2015 | Ku | |
| 9,269,178 | B2 | 2/2016 | Piemonte | |
| D758,417 | S | 6/2016 | Chaudhri | |
| D763,305 | S | 8/2016 | Hashimoto | |
| D766,328 | S | 9/2016 | Lee | |
| 9,478,107 | B2 * | 10/2016 | Nakamura | G07F 17/3265 |
| D780,218 | S | 2/2017 | Gaubert | |
| D780,776 | S | 3/2017 | Thompson | |
| D791,171 | S | 7/2017 | Sun | |
| D815,128 | S | 4/2018 | Phillips | |
| D821,439 | S | 6/2018 | Sowden | |
| D826,974 | S | 8/2018 | Perez-Bravo | |
| 10,101,861 | B2 | 10/2018 | Kiyoto | |
| D834,052 | S | 11/2018 | Baldi | |
| D839,304 | S | 1/2019 | Penacho | |
| 10,474,277 | B2 | 11/2019 | Pant | |
| 2006/0036950 | A1 | 2/2006 | Himberger | |
| 2007/0294636 | A1 | 12/2007 | Sullivan | |
| 2008/0090636 | A1 * | 4/2008 | Lathrop | G07F 17/34 463/20 |
| 2010/0120489 | A1 * | 5/2010 | Meyer | G07F 17/32 463/19 |
| 2013/0122988 | A1 * | 5/2013 | Guinn | G07F 17/3211 463/20 |
| 2013/0184046 | A1 * | 7/2013 | Vermaak | G07F 17/3265 463/20 |
| 2013/0331167 | A1 * | 12/2013 | Meistrich | G07F 17/34 463/20 |
| 2014/0132524 | A1 | 5/2014 | Lee | |
| 2014/0235306 | A1 | 8/2014 | Walls | |
| 2014/0349737 | A1 * | 11/2014 | Meyer | G07F 17/326 463/20 |
| 2015/0087382 | A1 * | 3/2015 | Gilbertson | G07F 17/326 463/20 |
| 2015/0379807 | A1 * | 12/2015 | Zhang | G07F 17/34 463/20 |
| 2017/0038904 | A1 | 2/2017 | Murata | |
| 2018/0130308 | A1 * | 5/2018 | Berman | G07F 17/3267 |
| 2018/0276941 | A1 * | 9/2018 | Meyer | G07F 17/34 |
| 2019/0073860 | A1 | 3/2019 | Reynolds | |
| 2019/0392683 | A1 * | 12/2019 | Halvorson | G07F 17/3269 |

OTHER PUBLICATIONS

CasinoJournal.com, "Elvira, Mistress of the Dark Class III Video Slot Machine-Aristocrat Technologies", Aug. 3, 2016, 2 pages.
"Elvira, Mistress of the Dark", 1 page.
Video Game Cross Icon, iconswebsite.com [online], published on Dec. 7, 2017, [retrieved on Apr. 26, 2019], retrieved from the Internet [URL: http://iconswebsite.com/shutterstock-image/video-game-cross-icon-770723551.html 1/] (Year: 2017).
2016 AQS Christmas Countdown: Day 11, by Langford, aqsblog.com [online], published on Dec. 11, 2016, [retrieved on Mar. 30, 2019], retrieved from the Internet <URL: http://www.aqsblog.com/author/betsey-langfordamericanquilter-com/page/64> (Year: 2016).
Jean's Diamonds Quilt Pattern, by Hoog, thecraftyquilter.blogspot.com [online], published on Sep. 19, 2011, [retrieved on Mar. 29, 2019], retrieved from the Internet <URL: http://thecraftyquilterblogspot.com/2011/09/jeans-diamonds-quilt-pattern.html> (Year: 2011).
Solve My Maths Area Problem #36, solvemymaths.corn [online], published on Dec. 3, 2016, [retrieved on Mar. 29, 2019], retrieved from the Internet <URL: https://solvemymaths.eom/category/solve-my-maths/written-by-me/page/3/> (Year: 2016).
Chart 67: Alice, Block 3 in the Farmer's Wife 1930s Sew Along, by Michell, frommartimichell.blogspot.com [online], published on Sep. 5, 2016, [retrieved on Mar. 30, 2019], retrieved from the Internet <URL: http://frommartimichell.blogspot.com/2016/09/chart-67-alice-block-3-in-farmers-wife.html> (Year: 2016).
Hemocytometer Calculation, by BioLab Protocols, YouTube [online], published on Apr. 21, 2013, [retrieved on Mar. 29, 2019], retrieved from the Internet <URL: https://www.youtube.com/watch?v=wF-VVyisbGw> (Year: 2013).
How to Count the Number of Positions of Rubik's Cube, by DavidA, haskellformaths.blogspot.com [online], published on Aug. 1, 2009, [retrieved on Mar. 29, 2019], retrieved from the Internet <URL: http://haskellformaths.blogspot.com/2009/08/how-to-count-number-of-positions-of.html> (Year: 2009).
Trademark Registration Serial No. 78234251, May 25, 2010 (publication date), (Registrant) 4Teus Solutions, Limited Liability Company, United Kingdom, Trademark Electronic Service System (TESS), available atwww.uspto.gov (Year: 2010).
Oldskoolish: UI, by Anceau, iconfinder.com [online], published on Aug. 28, 2017, [retrieved on Mar. 30, 2019], retrieved from the Internet <URL: https://www.iconfinder.com/iconsets/oldskoolish-ui> (Year: 2017).
Office Action dated Apr. 30, 2020 for U.S. Appl. No. 29/615,904 (pp. 1-13).
"Money Comb" screenshots 12 pages.

* cited by examiner

| | | | | |
|---|---|---|---|---|
| King | Queen | Ace | WILD | King |
| Ace | WILD | Queen | King | Ace |
| Jack | King | WILD | Queen | Jack |

FIG. 10A

| | | | | |
|---|---|---|---|---|
| King | Queen | Ace | WILD | King |
| Ace | WILD | Queen | King | Ace |
| Jack | King | WILD | Queen | Jack |

FIG. 10B

| | | | | |
|---|---|---|---|---|
| King | Queen | Ace | WILD | King |
| Ace | WILD | Queen | King | Ace |
| Jack | King | WILD | Queen | Jack |

FIG. 10C

| | | | | |
|---|---|---|---|---|
| King | Pic 1 | Pic 1 | King | King |
| Pic 1 | Queen | Queen | Queen | Ace |
| Queen | King | Jack | Jack | Jack |

FIG. 16A

| | | | | |
|---|---|---|---|---|
| King | Pic 1 | WILD x2 | King | King |
| Pic 1 | King | Ace | King | Ace |
| Queen | King | Jack | Jack | Jack |

FIG. 16B

| | | | | |
|---|---|---|---|---|
| King | Pic 1 | Pic 1 | King | King |
| Pic 1 | Queen | Queen | Queen | Ace |
| Queen | King | Jack | Jack | Jack |

FIG. 17A

| | | | | |
|---|---|---|---|---|
| King | Pic 1 | WILD x2 | King | King |
| Pic 1 | Queen | Pic 1 | Queen | Ace |
| Queen | King | Queen | Jack | Jack |

FIG. 17B

INTERACTIVE ELECTRONIC REEL GAMING MACHINE WITH A SPECIAL REGION

RELATED APPLICATION(S)

The present application claims priority to U.S. Provisional Patent Application No. 62/553,980, filed Sep. 4, 2017, and entitled "A SYSTEM AND METHOD OF GAMING" which is hereby incorporated by reference in its entirety.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

Conventional electronic reel games display three reels that represent mechanical reels. Such conventional games accepted a single input (e.g., start), and show a row of symbols, typically three in a vertically spinning reel. All three symbols must match to provide a payout. Gaming machines that offer these types of games provide limited functionality, allow for limited player interaction. A need exists in the industry to improve gaming machine operations and player interactions.

SUMMARY

Systems, devices and methods for an interactive electronic reel game that includes special regions are disclosed. For instance, a game controller is configured to provide a reel with a particular arrangement of display positions, where each display position includes a separately controlled individual reel. Following receipt of a user input, one or more of the individual reels are spun and stopped, displaying symbols (e.g., corresponding to playing cards, pictures, credit values, etc.) in one or more of the display positions. In a particular example, the reels represent character(s) and/or reference(s) to the X-Files media program (e.g., Agents Mulder and/or Scully, alien character(s) and/or reference(s), etc.). The game controller is configured to apply a multiplier to symbols displayed in the special region. Pay awards are made when clusters of two or more like symbols are located in adjacent display positions. The pay award is increased if one or more symbols of the cluster is located in a display position corresponding to the special region. The symbol display positions are configured in a geometric shape.

In other disclosed examples, an interactive electronic gaming machine configured to receive and interpret an input from a user to implement a reel game that includes special regions. The electronic gaming machine includes a credit input configured to receive an item to establish a credit balance, the credit balance being increasable and decreasable based at least on wagering activity. The electronic gaming machine further includes a display having a plurality of symbol display positions configured on the display in a geometric shape comprising a special region that includes two or more symbol display positions that are configured to assign a multiplier to one or more symbols within symbol display positions of the special region. A plurality of symbol reels are spinnable to display symbols at the symbol display positions. A game controller operable in accord with the credit balance, the game controller being configured to spin a first set of symbol reels in a different direction than spinning of a second set of symbol reels in response to a user input, to stop the symbol reels by stopping the first set of symbol reels before the second set of symbol reels, and to determine the symbols located in clusters of the symbol display positions, and wherein the controller. Further, a payout system is configured to cause a payout associated with a game win.

In yet another disclosed example, a method employs an interactive electronic gaming machine configured to receive and interpret an input from a user to implement a reel game that includes a special region. For instance, the method includes receiving, via a credit input, an item to establish a credit balance, the credit balance being increasable and decreasable based at least on wagering activity. The method also includes displaying, via a display, a plurality of symbol display positions configured in a geometric shape comprising a special region that includes two or more symbol display positions, assigning a multiplier to symbols within symbol display positions of the special region, and spinning, by a game controller, a plurality of symbol reels at the symbol display positions, wherein the plurality of symbol reels comprises a first set of symbol reels configured to spin in a first direction and a second set of symbol reels configured to spin in a second direction different from the first direction, the first and second direction including top to bottom, bottom to top, left to right, right to left, inward to outward, or outward to inward. The method further includes stopping, by the game controller, the first set of symbol reels and then the second set of symbol reels, determining, by the game controller, symbols located in clusters of the symbol display positions, and determining a game outcome to generate a payout associated with symbols located in clusters.

BRIEF DESCRIPTION OF THE DRAWINGS

FIGS. 10A-10C illustrate another example game where the location and size of the special region changes.

FIGS. 16A and 16B illustrate example reel games where symbols that make up a winning combination are removed and replaced with new symbols.

FIGS. 17A and 17B illustrate example games where a player is able to select one or more symbols for removal.

DETAILED DESCRIPTION

Figure 1:
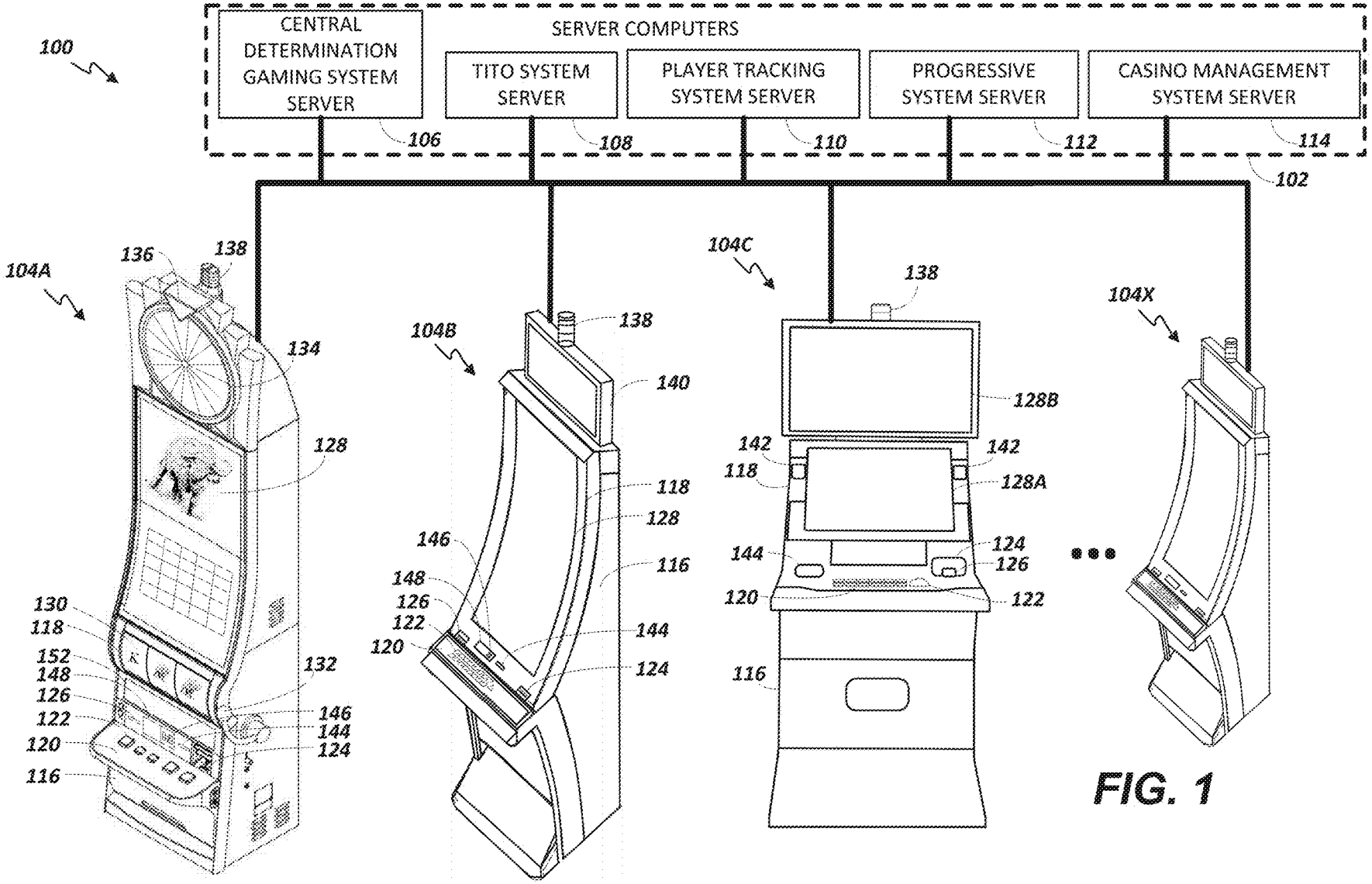
FIG. 1 is an exemplary diagram showing several EGMs networked with various gaming related servers.

Systems, devices and methods for an interactive electronic reel game that includes special regions are disclosed. For instance, a game controller is configured to provide a reel with a particular arrangement of display positions, where each display position includes a separately controlled individual reel. Following receipt of a user input, one or more of the individual reels are spun and stopped, displaying symbols (e.g., corresponding to playing cards, pictures, credit values, etc.) in one or more of the display positions. In some examples, the symbol display positions are configured in a shape of an "X."

In some examples, the gaming device is configured to apply a multiplier to symbols displayed in each display position located within a designated "special region". The special region can include a single or multiple display positions. The display position(s) corresponding to the special region can be fixed within the reel, or can change in response to a trigger (e.g., an increased wager, a subsequent spin of the reel, a bonus play, etc.). Moreover, two or more special regions can be identified on a single reel, with each applying the same or a different multiplier to the symbol values within the display positions assigned to the respective special region.

In some examples, when the individual reels are spun, the reels spin in different directions and stop beginning from the innermost positions and then outward, such as by placing emphasis on the middle positions of an X-shape reel and creating a visually appealing presentation. Individual reels can be spun and stopped in various patterns and/or with various timings.

A game outcome can be evaluated based on the displayed symbols, such as the value and/or location of a particular symbol within the reel. Pay awards can be made according to the symbols in clusters of display positions, such as when two or more like symbols are located in adjacent display positions. The awards are based on the size of groups of symbol positions (clusters), and thus are very identifiable and intuitive to the player. The pay award can be increased if one or more symbols of the cluster is located in a display position corresponding to the special region.

As described more fully with respect to the several figures, the interactive EGM of the present disclosure provides a non-conventional arrangement for an EGM, in particular, an electronic reel game. As stated above, conventional games accept a single input to start a game, and show a single row of three symbols. All symbol positions are identical (e.g., in a vertically spinning reel) and treated the same. The three symbols in such games must match to provide a payout.

The present disclosure solves challenges that are rooted in technologies associated with modern wagering gaming machines, systems and methods. In particular, the wagering gaming machines, systems and methods generate a wagering game, which is presented to a player. In response to the presented gameplay, a plurality of inputs are received from the player and interpreted. An outcome is determined based on the game and the inputs, and the player is rewarded accordingly. During gameplay, the technology that implements the wagering gaming machines, systems and methods are uniquely configured to focus on the gaming presentation (e.g., visual, audio, haptic, etc.) provided to the player over extraneous functionality, as well as accepting a limited number and variety of inputs from the player, in order to provide a more responsive experience.

For example, in the interactive reel game described with respect to FIGS. 3-24, the presentation themes are focused (in this example, to symbols in an X-shaped display, providing a special region), the networked information is focused (e.g., to presentation elements, security features associated with wagering games, etc.), as well as the player inputs. For instance, by accepting only a focused set of inputs, such as to start and stop the reels, the direction of reel spin, symbol selection, etc., the machines, systems and methods described herein operate efficiently and with greater accuracy, while employing fewer computing resources than would be required on general purpose machinery.

FIG. 1 illustrates several different models of EGMs, which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smartphone, a tablet, a laptop, or a game console.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction, which may be aligned in rows or banks of similar devices for placement and operation on a casino floor. The gaming device 104A often includes a main door 118 that provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118, which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel, which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking server system 110 to send and receive player-tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152, which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
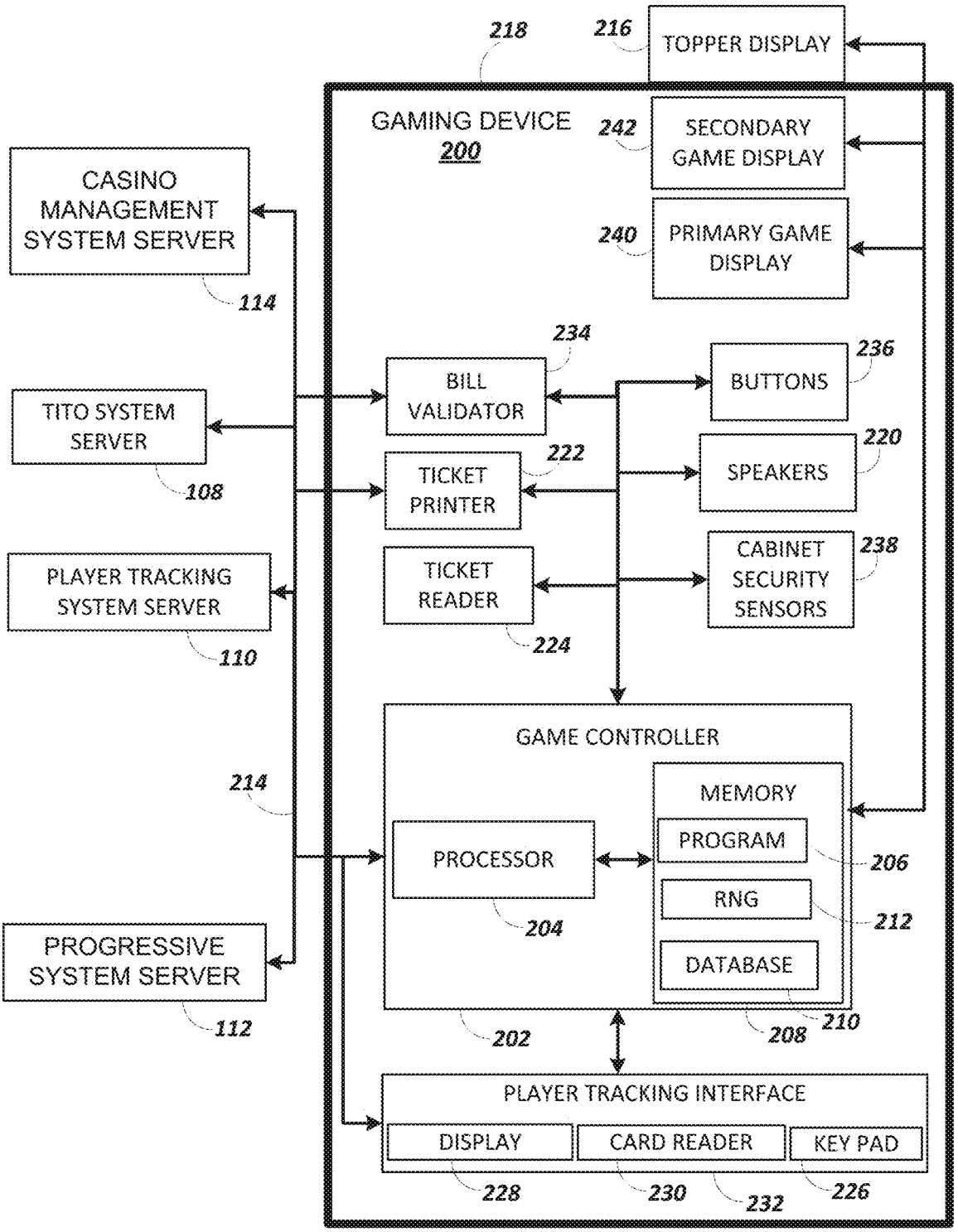
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 118, which opens to provide access to the interior of the gaming device 104B. The main or service door 118 is typically used by service personnel to refill the ticket-out printer 126 and collect bills and tickets inserted into the bill validator 124. The door 118 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

In the embodiment, the game controller controls generation and display of one or more special regions or zones and the application of multipliers, etc. by use of the RNG, as discussed in more detail with respect to the several figures. Additionally, an award amount is awarded based on play of a reel game that includes the special region.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smartphone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during the course of game play (such as spinning a wheel to begin a bonus round or select various items during a feature game). The player may make these selections using the player-input buttons 236, the primary game display 240 which may be a touchscreen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Figure 3A:
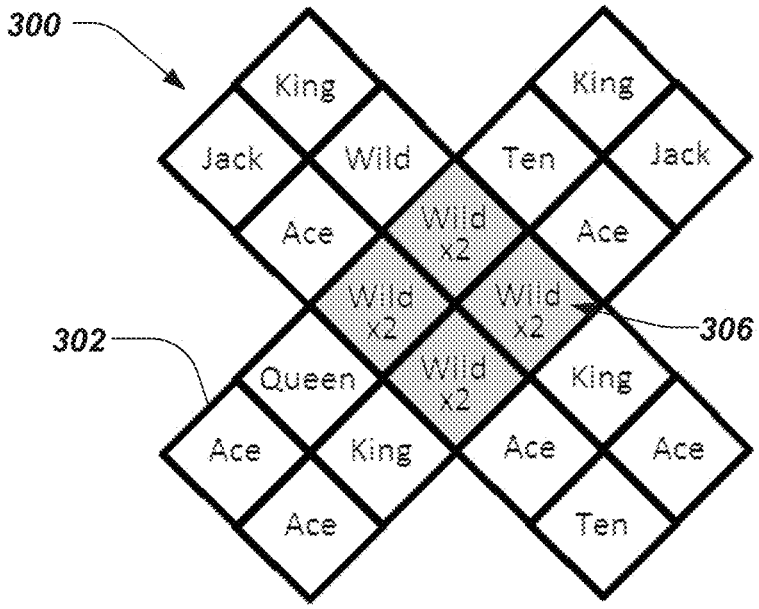
FIGS. 3A and 3B illustrate an example interactive electronic reel game operating on a gaming device.
Figure 3B:
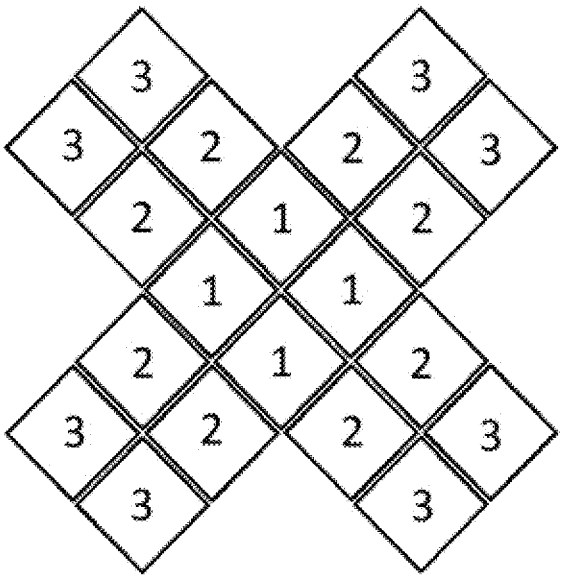
Figure 4A:
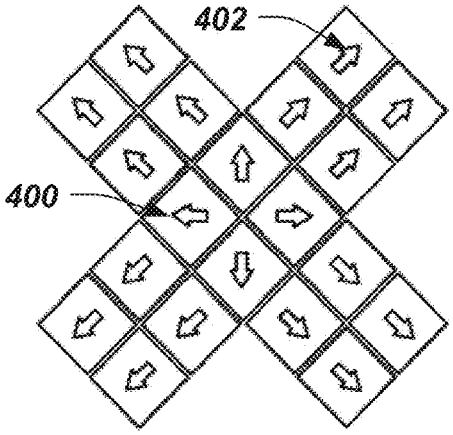
FIGS. 4A-4F illustrate example spin directions for the interactive electronic reel game.
Figure 4B:
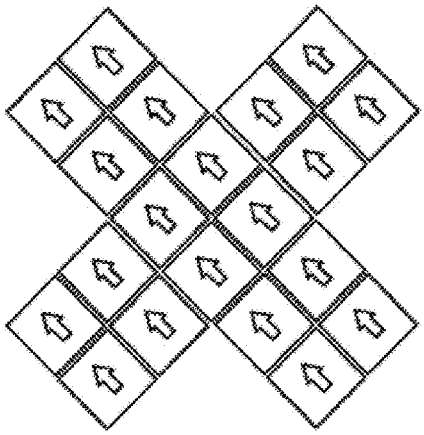
Figure 4C:
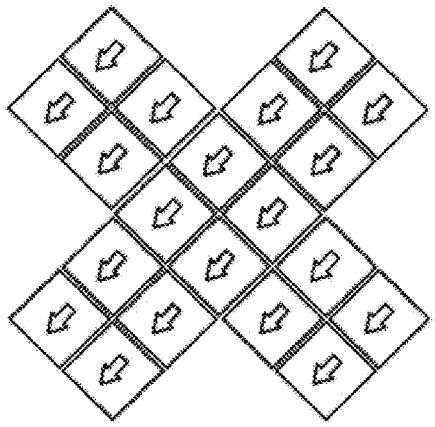
Figure 4D:
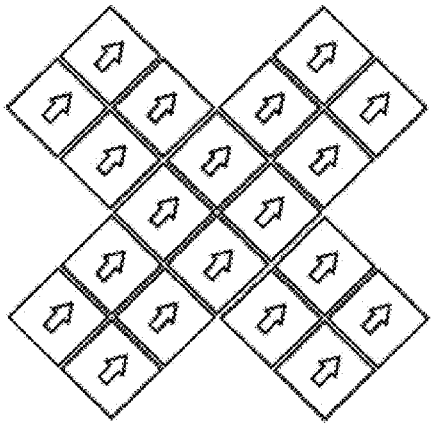
Figure 4E:
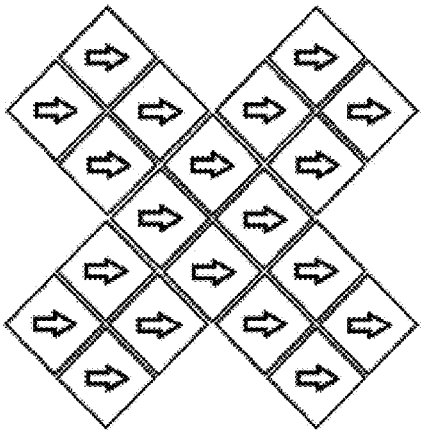
Figure 4F:
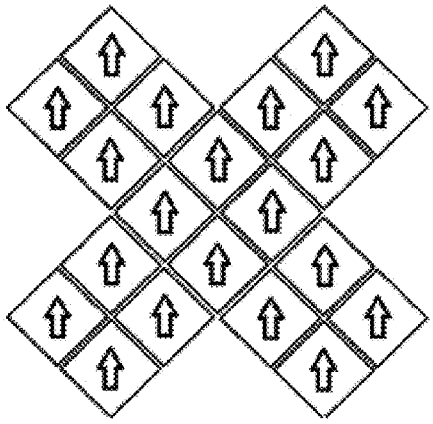

Systems, devices and methods for an interactive electronic reel game are disclosed. For instance, FIGS. 3A and 3B illustrates display on an example interactive electronic reel game operating on a gaming machine or device, such as gaming devices 104A-104X, that includes a game controller, such as game controller 202, configured to provide a reel 300 with a particular arrangement of display positions 302, where each display position includes a separately controlled individual reel. Following a spin of one or more of the individual reels, symbols (e.g., corresponding to playing cards, pictures, credit values, etc.) are displayed in one or more of the display positions.

In some examples, the gaming device is configured to apply a multiplier to symbols displayed in individual reels within each display position 302, such as to "wild" symbols (i.e. symbols that do not have a predetermined value assigned) that land in individual reels located within a designated "special region" 306, or special zone (identified by grey highlighting). The special region 306 can include a single or multiple display positions, four in the example of FIG. 3A. The display position(s) 302 corresponding to the special region 306 can be fixed within the reel 300, or can change in response to a trigger (e.g., an increased wager, a subsequent spin of the reel, a bonus play, etc.). Moreover, two or more special regions can be identified on a single reel, with each applying the same or a different multiplier to the symbol values within the display positions assigned to the respective special region.

A game outcome can be evaluated based on the displayed symbols, such as the value and/or location of a particular symbol(s) within the reel. Pay awards can be made according to the symbols in clusters of display positions, such as when two like symbols are located in adjacent display positions. As noted, the pay award can be increased if one or more symbols of the cluster is located in a display position corresponding to the special region.

Figure 5A:
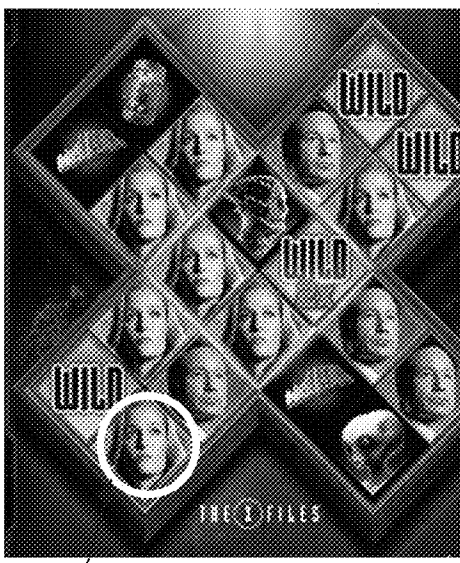
FIGS. 5A-5C illustrate example play and outcomes of the interactive electronic reel game.
Figure 5B:
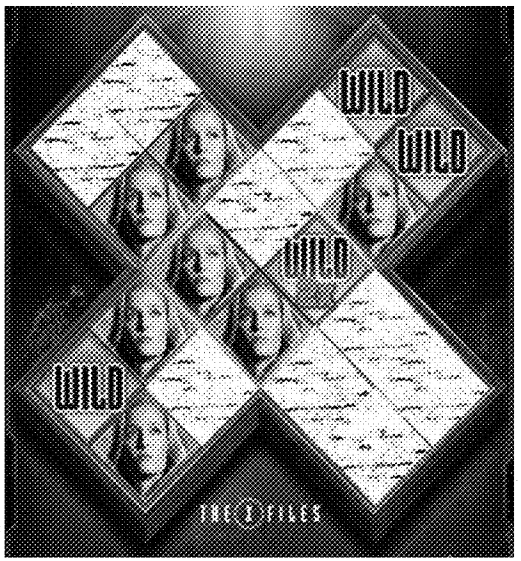
Figure 5C:
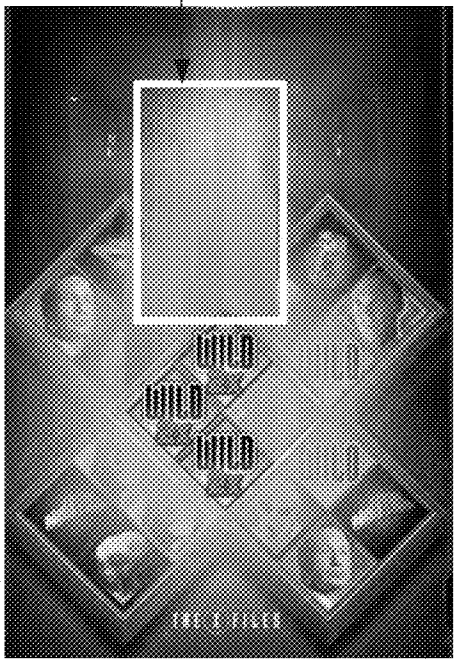

As shown in FIG. 3A, the symbol display positions are configured in a shape of a large "X." In the example of FIG. 3A, a symbol is placed in each display position 302 associated with a separate individual reel. The gaming machine can incorporate various themes selected to attract players (e.g., representing popular cultural references, such as the X-Files program characters, as shown in FIGS. 5A-5C). Symbols within the symbol display positions (e.g., individual reel positions) could be themed to any theme and the X-shape could also be changed to other shapes (see, e.g., FIGS. 22A and 22B). Further, a variety of stimuli can be employed in response to a trigger (e.g., a winning outcome), including visual, audible, haptic feedback, etc., to engage and inform the player.

In the example of FIG. 3A, twenty diamond shaped display positions 302 are arranged to form the large X-shape. Each diamond shaped display position is associated with an individual reel, which is arranged to provide a symbol into the display position. The awards are based on the size of groups of symbol positions (clusters), and thus are very intuitive to the player. Using diamond shaped symbols, the X-shape of the overall layout is very clear, as seen in FIGS. 3A and 3B.

In some examples, when the individual reels are spun, the reels spin in different directions and stop beginning from the innermost positions and then outward (or vice versa), placing emphasis on the middle four positions of the X-shape and creating a visually appealing presentation. As shown in FIG. 3A, since each display position is an individual reel, the reels can be spun and stopped in various patterns and/or with various timings.

FIG. 3B illustrates the reels being spun/stopped in a pattern beginning from the middle-most positions (identified as group 1) then outward (to group 2, and then to group 3) to make the reel spins interesting and to give emphasis to the center four positions. The diagram of FIG. 3B shows the order in which the symbols stop, such that reel positions with the number 1 all stop at the same time, then the reel positions with the number 2 all stop next at the same time, and then reel positions with the number 3 all stop next and at the same time.

The direction of spin of each reel in a display position can also be varied to make the overall presentation more attractive. Several examples of the direction of each individual reel spins in an X-shaped layout are shown in FIGS. 4A-4F. For instance, a first direction 400 can be assigned to a first set of symbol reels in a central area of the X-shaped layout (e.g., four symbol reels within the middle of the X). In some examples, this central area corresponds to a special region. A second direction 402 can be assigned to a second set of symbol reels located outside the central area. The reel positions can also be started and/or stopped based on their association (e.g., with directions 400 and/or 402), such as first then second, slowly or quickly, etc.

The various directions can be implemented randomly, such as for different spins, or in response to a user input. For instance, the reel spin choreography can be changed based on a player input, such as a swipe direction across the screen. In this manner, the player customizes the spin direction, providing interaction with the gameplay. Further, the game can be configured to start and/or stop, as well as speed up or slow down the rate of spin, in response to the player input (via swipe, tap or other means).

In some examples, the gaming machine is directed to applying a multiplier to individual reels, such as to wild symbols that land in a special region of the reel window. The special region can be designated while the reels are spinning so that the player can anticipate having wilds land in the special zone. As the symbols land in the special zone, sound and/or animation could be used to emphasize when wilds land. Wild symbols that land within the special zone have a multiplier applied to them as the reels stop spinning.

Returning to the example shown in FIG. 3A, the central four reels contain "Wild ×2" symbols, surrounded by reels representing playing card values (e.g., Ten, Jack, Queen, King, Ace). Then, any wins that use that wild symbols will have the multiplier applied to those wins. In the example cluster pay game shown in FIG. 3A, wilds that land in the special region have a multiplier applied to them. If one or more of the special wilds substitutes in a winning combination of symbols (e.g., a line or cluster), that win is multiplied by the product of the special wild multipliers. This special region can be applied to line games, reel power games, or cluster pay games, for example.

In the example shown in FIG. 5A, the special region is the center four display positions. In the example, there is a single 11-of-a-kind "Scully" corresponding to the pictographic image 500 of Agent Dana Scully from the X-Files program, further highlighted in FIG. 5B. Since one wild landed in the special region (i.e. the center four display positions), that wild will have a "2×" multiplier placed on it. The pay for this 11-of-a-kind win would be multiplied by 2. The cluster pay evaluation is simple and intuitive; in other words, symbols are grouped which share a common edge.

Furthermore, when a win is increased by a wild landing in the special region, a stimulus can be generated to enhance the player experience. The example of FIG. 5B shows an animation 502 occurring, as three wilds landed in the special region. This can occur, for example, during the reel spin. For example, a visual, audible, or haptic feedback can be presented to excite and inform the player.

In the example of FIG. 5C, an animation can take the form of a set of wispy lines emanating from each wild symbol, as shown below. This animation can leave the screen display before the next reel located outside of the special region is stopped, or at another time or in response to a particular stimulus (e.g., in response to a player input).

Figure 6A:
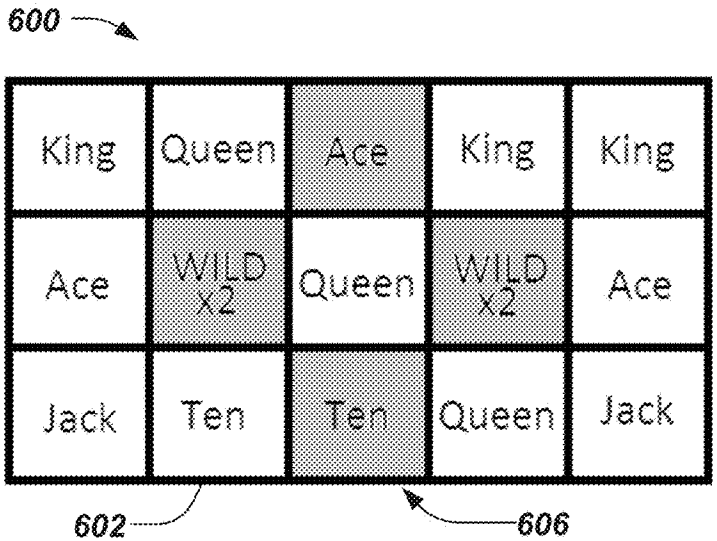
FIGS. 6A and 6B illustrate an example line game that includes a special region.
Figure 6B:
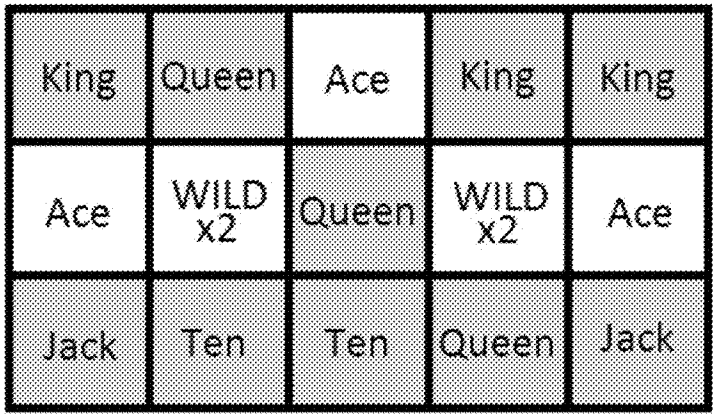

FIGS. 6A and 6B represent an example line game 600 with a particular arrangement of display positions 602, where each display position includes a separately controlled individual reel. Further, the game 600 includes a special region 606. For example, wild symbols that land in the special region in a line game have a multiplier applied to them. If one or more of the special wilds substitutes in a line win, that win is multiplied by the product of the special wild multipliers.

In the example shown in FIG. 6A, the special region is shown in grey. As shown, two wilds appear in the grey region. Thus, those two WILDs have an indicator "×2" applied to them when these WILDs stop in their display positions in the special region. Thus, a single 5 of a kind (i.e. Aces in the example of FIG. 6B) will pay. The line of the five Aces is highlighted in white in FIG. 6B. Accordingly, since there are 2 wilds that have landed in the special region, with ×2 multipliers on each, the payout would be multiplied by 4.

Figure 7A:
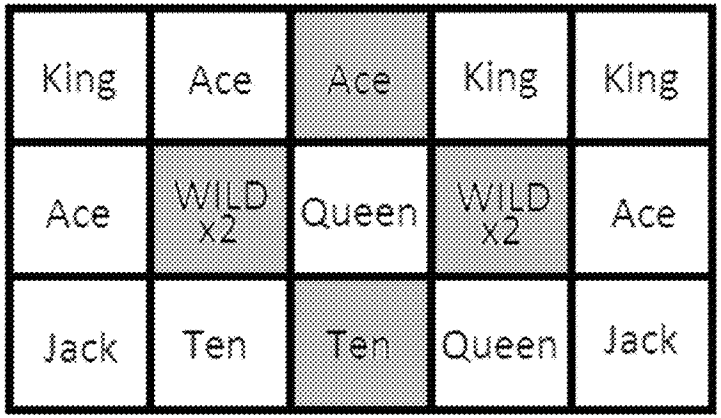
FIGS. 7A and 7B illustrate an example reel game.
Figure 7B:
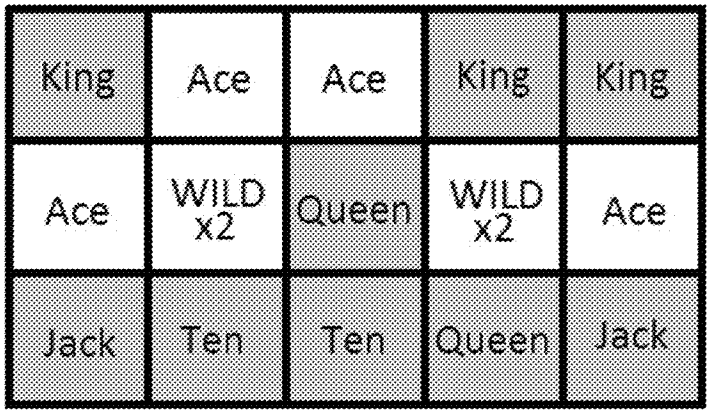

FIGS. 7A and 7B represent an example reel power game. For example, wilds that land in the special region in a reel power game have a multiplier applied to them. If one or more of the special wilds substitutes in a win, that win is multiplied by the product of the special wild multipliers. Alternatively, the win may be multiplied by the sum of the special wilds' multipliers. In the example shown in FIG. 7A the special region is shown in grey.

In the example of FIGS. 7A and 7B, there are 5-of-a-kind Ace pays only. The line of the five Aces is shown highlighted in white in FIG. 7B. Even without accounting for the multipliers, this would pay a win. However, the win is multiplied by 4 (since there are 2 "WILD ×2" symbols in the win) and thus the payout is increased accordingly.

Figure 8A:
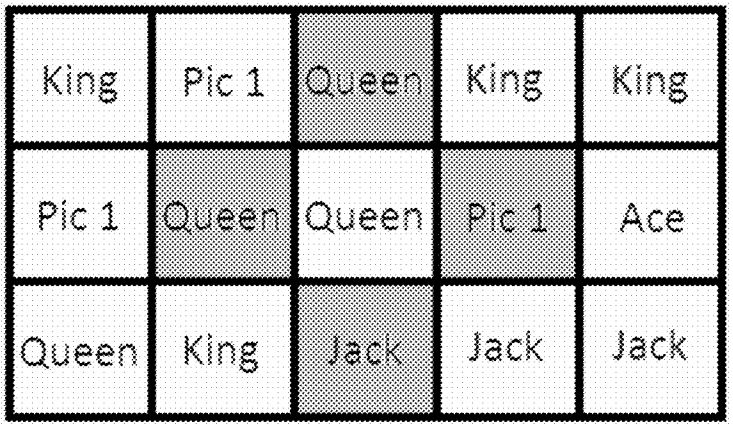
FIGS. 8A and 8B illustrate an example game where a user input can select and change position of one or more tiles within the special region during gameplay.
Figure 8B:
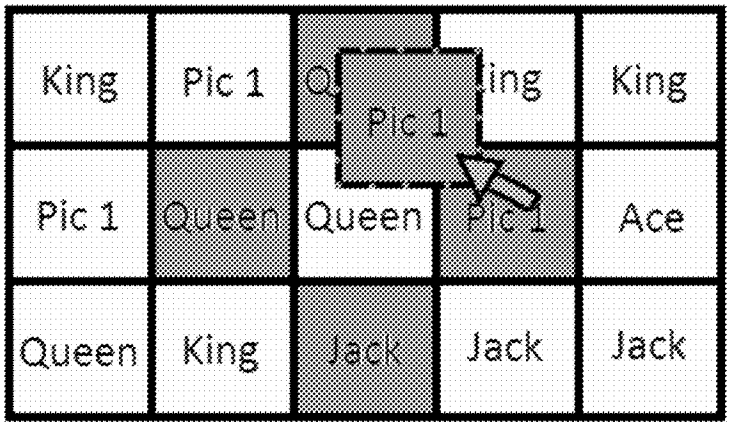

FIGS. 8A and 8B represent an example game where a user input can select and change the position of one or more tiles within the special region during gameplay. For example, when the reels land, individual reel symbols positioned within the special region can be swapped with another reel symbol within the special region. This interactive approach provides the player with an opportunity to modify the outcome based on skill-based interaction with the game.

In this example, the reels are spun and land, as shown in FIG. 8A. After the reels have come to a stop, the player can swap tiles that are located within the special region. The player can swap tiles by touching and dragging one symbol in the special region and letting go. In the example of FIG. 8B, a symbol or other picture, identified as "Pic 1," is swapped with "Queen." As a result, the new layout provides a win for Pic 1.

Figure 9A:
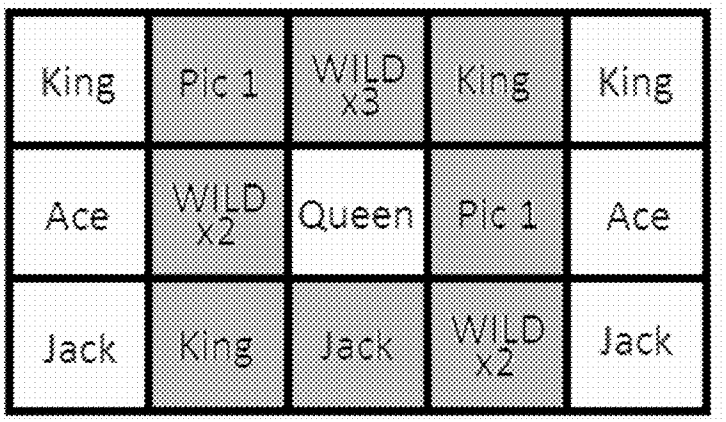
FIGS. 9A and 9B illustrate an example game where the shape and/or size of the special region can change.
Figure 9B:
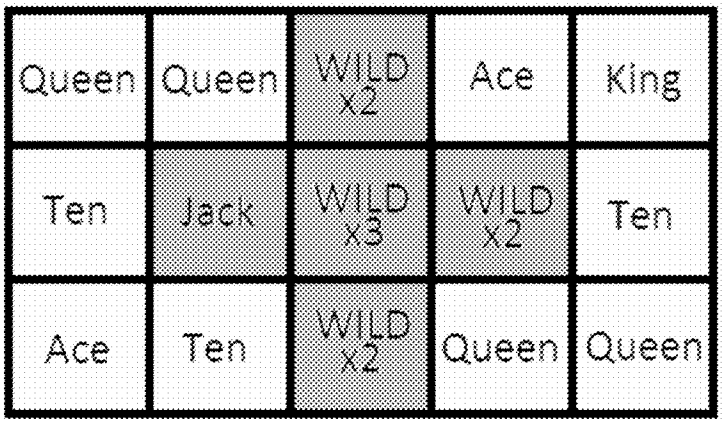

FIGS. 9A and 9B represent an example game where the shape and/or size of the special region can change. The variation of the special region, and the expectation of an increased payout, adds variety and excitement to gameplay. Such a change might be randomized or in response to a player input (e.g., based on additional wager amounts), for example. For instance, the special region may increase in size or move to a more favorable position (e.g., increasing the number of adjacent reels to each reel within the special region) as the wager amount is increased or as an ante bet is made.

In examples, the special region may be applied to the reel window before the first spin, during spin of the reels, after the reels have stopped, or some other predetermined or random time. This would occur while the reels are spinning so that the player can anticipate having wilds land in the special region. As the symbols land in the special region, a stimulus (e.g., sound, animation, color, vibration, etc.) may be used to emphasize when wilds land within the special region. Any wilds that land within the special region may have a multiplier applied to them, for example, as the reels stop. The special region could stay the same from spin to spin, or it could change in size, shape, and/or location depending on the game design. Such changes could be useful for line games, Reel Power games, or Cluster Pay games.

For example, the location of the individual symbols of the special region and/or the number of reel positions that comprise the special region can change. This can be implemented in response to a spin, such as a first special region based on a first spin, as shown in FIG. 9A, and a second special region based on a second spin, as shown in FIG. 9B. The shape and/or size (i.e. number of reel positions) within the special region can be the result of an ordered pattern (e.g., starting with eight reel positions at the first spin shown in FIG. 9A, transitioning to five reel positions at the second spin, shown in FIG. 9B), can be randomly changed, or in response to other input or stimulus. For example, the first and second special regions may contain fewer than all of the reel positions, such that a specific subset of reels is located in each special region.

For instance, if a first spin reveals a first payout (e.g., multiple WILDs within the special region), the special region can increase or change shape to reward the player (e.g., to increase the chances of the special region resulting in a winning combination). Additionally or alternatively, the special region can decrease in size and/or change position, further challenging the player. Consistent with these changes, the number of wilds or the multiplier of each can change along with the special region, further enhancing the player experience.

FIGS. 10A-10C represent another example game where the location and size of the special region changes. In the examples shown, the special region, highlighted in grey, is limited to the right three reel positions, as shown in FIG. 10A. In response to a stimulus, such as a player input, the special region can change. For example, FIG. 10B represents an increase in size of the special region, from three reel positions to six. This can be in response to an increased wager, selecting a maximum wager, a second or free spin, previous payout amount, or randomly applied during gameplay. FIG. 10C illustrates an example where the special region includes all available reel positions. Accordingly, any wild that lands following the spin may have a multiplier applied to it, thereby increasing the chance of a larger payout.

Figure 11A:
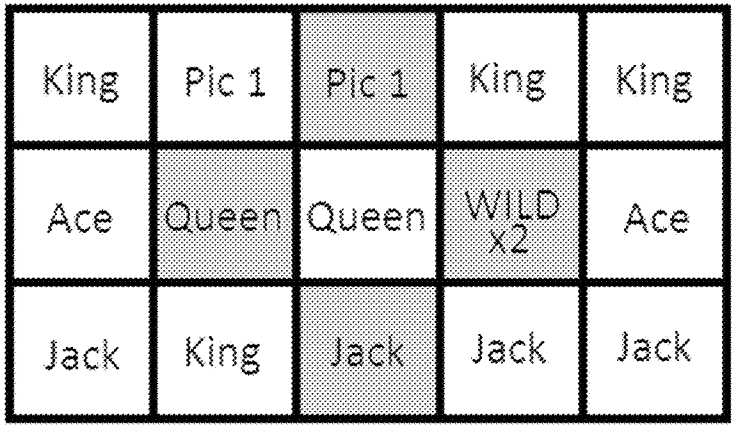
FIGS. 11A and 11B illustrate an example reel game where the special region changes in response to a spin.
Figure 11B:
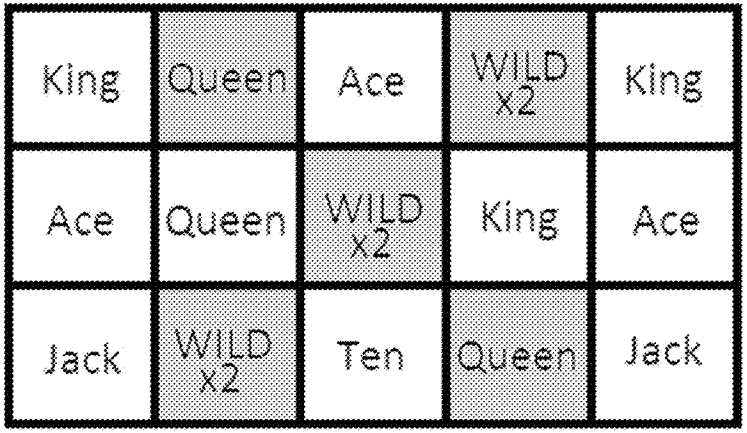

FIGS. 11A and 11B represent an example reel game where the special region changes in response to a spin, such as a free spin. In the example of FIG. 11A, a first or base spin presents the special region, highlighted in grey, as including four reel positions. In a subsequent and/or free spin, the special region changes to further encourage gameplay. For example, FIG. 11B illustrates a special region that includes five reel positions, thereby increasing the odds of a larger payout.

Figure 12A:
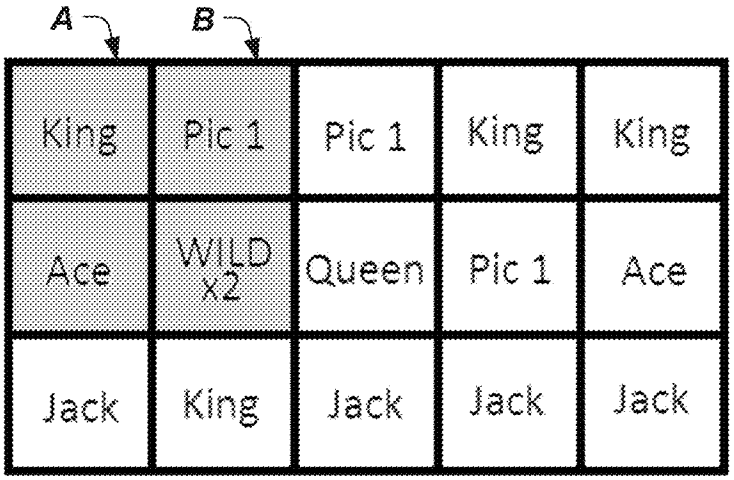
FIGS. 12A and 12B illustrate example special regions designed to change position on the reels.
Figure 12B:
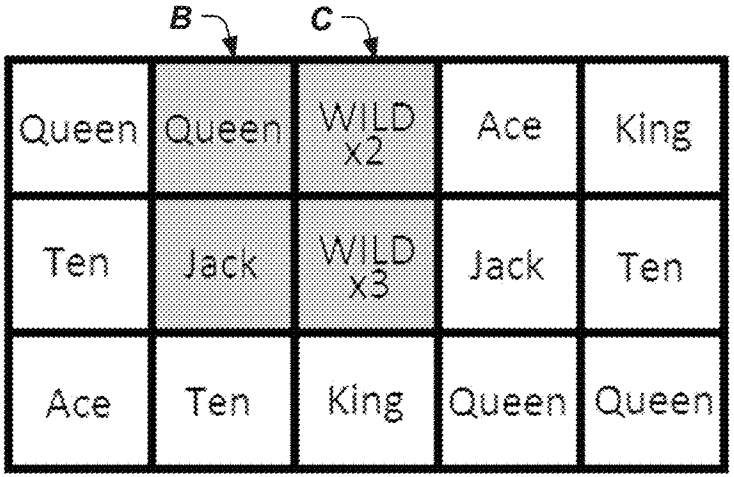

In yet another example, the special regions shown in FIGS. 12A and 12B are designed to change position on the reels. As shown in FIG. 12A, the special region includes four reel positions in the top two positions of first and second reels A and B. A wild within the special region has been identified as having a multiplier of ×2.

In response to a spin, user input, or other stimulus, the special region can move about the reel. The change can occur as the reels spin to draw in the player, or can be presented after the reels have stopped, thereby enhancing anticipation. Additionally or alternatively, the change in the special region can occur randomly and/or at some other time or rate. As shown in FIG. 12B, the special region has retained its size and shape, but has moved to the right, thereby occupying the top two reel positions of the second and third reels B and C. Consistent with the explanations provided herein, wilds that have landed within the special region have been assigned a multiplier, such as ×2 and ×3.

Figure 13A:
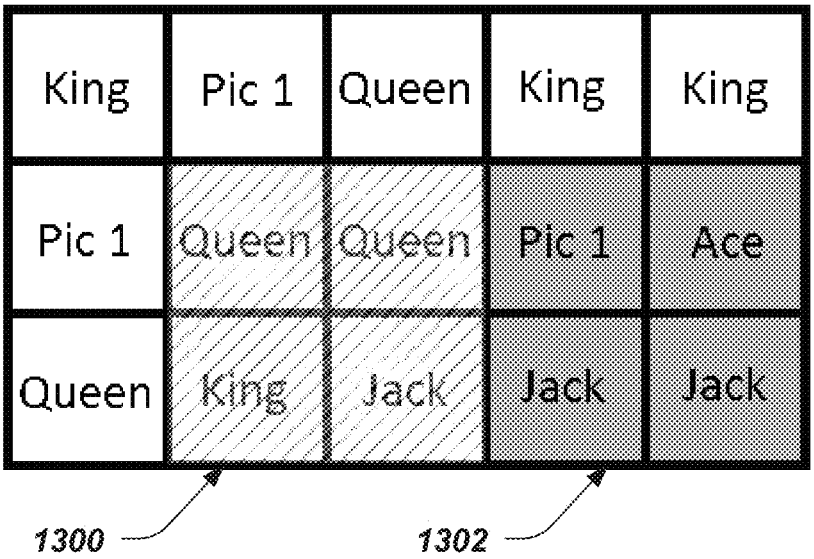
FIGS. 13A and 13B illustrate example games where a given spin can reveal multiple special regions.
Figure 13B:
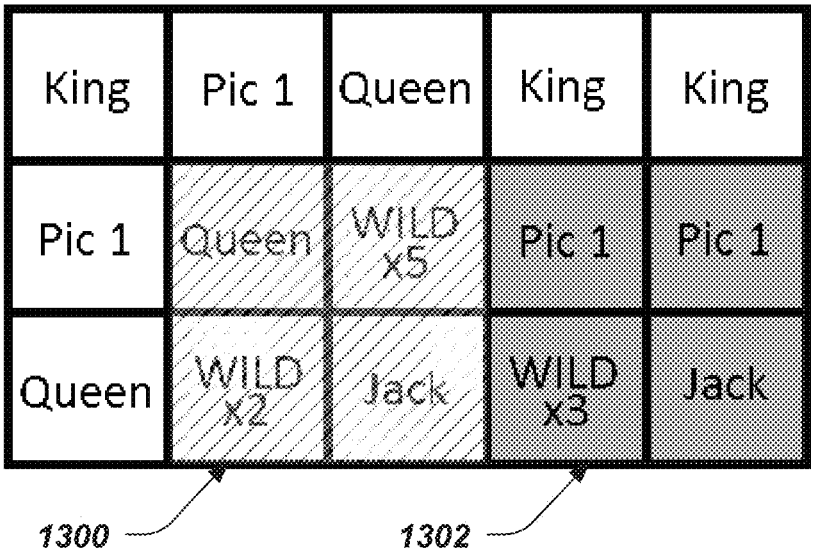

As shown in the examples of FIGS. 13A and 13B, a given spin can reveal multiple special regions. In some examples, the multiple regions can provide a single enhancement (e.g., a ×2 multiplier to wilds landing in each special region). In other examples, each special region can provide a different enhancement In the example of FIG. 13A, two special regions, 1300 and 1302, are identified. Wilds within the first special region 1300 apply a first set of effects to reel positions therein following a reel spin. Wilds within the second special region 1302 apply a second set of effects. Thus, as shown in FIG. 13B, the first special region 1300 can include wilds with multiple multipliers (e.g., 2× and 5×), whereas second special region 1302 applies a single multiplier (e.g., ×3) to wilds within the second special region 1302. Accordingly, the payout will be adjusted in response to the multipliers that are combined with a win during gameplay, further enhancing the player experience.

Figure 14A:
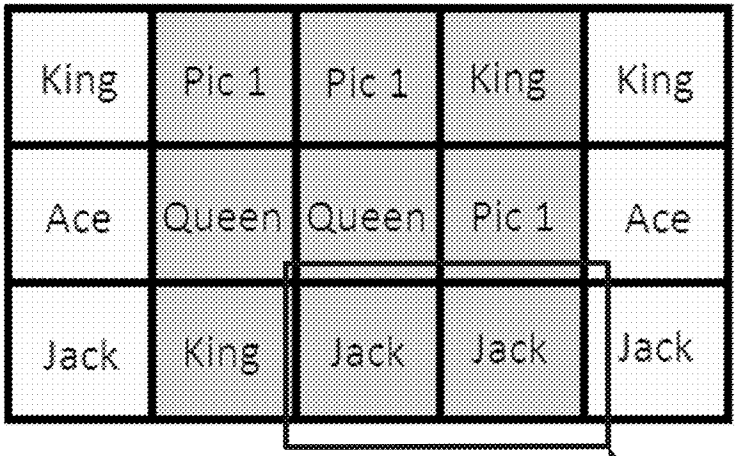
FIGS. 14A and 14B illustrate example reel games where one or more symbols are identified as subject to user modification.
Figure 14B:
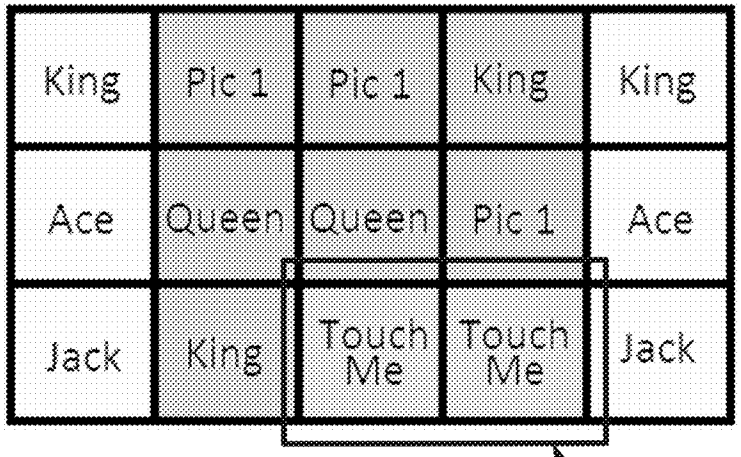

FIGS. 14A and 14B represent an example reel power game, where one or more symbols are identified as subject to user modification. In some examples, a particular symbol can be identified as available to the user for substitution, such that a chance reward can be revealed in response to a user input. In the example of FIG. 14A, Jack 1400 is identified as selectable by the player.

Touching or otherwise interacting with the symbol reveals a symbol 1402. For example, once the player touches the identified reel symbol, a credit amount or other indication of a win can be presented, be it visually, audibly, or by other types of feedback, as shown in FIG. 14B. However, in some examples, the change in symbol may be unfavorable. For example, in a game where like symbols identified in clusters offer a payout, revealing the hidden symbol may remove one such symbol, thereby reducing the payout.

Figure 15A:
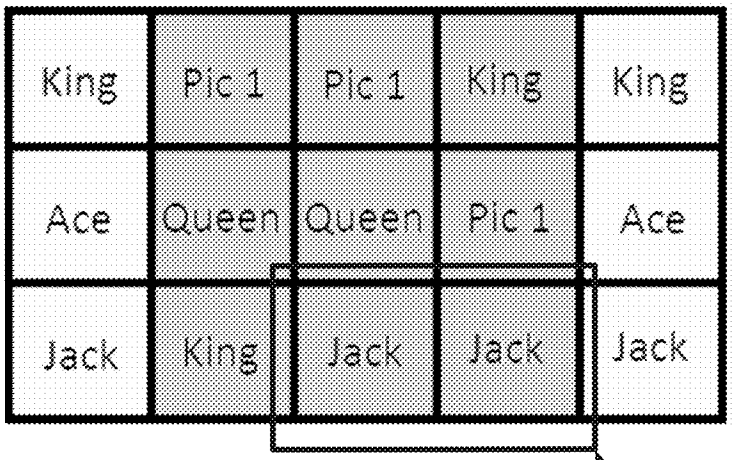
FIGS. 15A and 15B illustrate example reel games where a symbol can be identified for a secondary reveal after each spin.
Figure 15B:
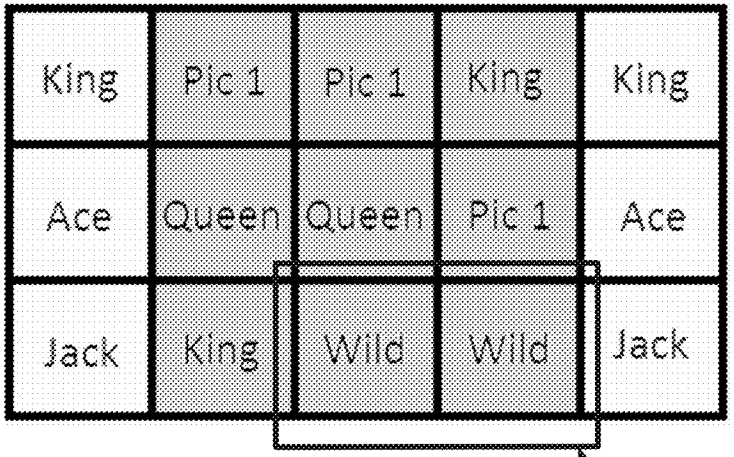

In the example of FIGS. 15A and 15B, a symbol can be identified for a secondary reveal after each spin. The symbol can be chosen at random and, when the reels have stopped, each reel position occupied by the identified symbol could be changed. If that symbol is located within a special region, the symbol can be changed to a wild and/or have a multiplier applied thereto. In the example of FIG. 15A, the Jack symbols 1500 within the special region, highlighted in grey, are identified for the secondary reveal. After the reels have stopped, the Jack symbols 1502 within the special region change to wild symbols, as shown in FIG. 15B. Such a secondary reveal can occur automatically or in response to other stimuli, such as increasing a wager. Further, the secondary reveal may result in a less favorable symbol in the designated position, for example, in a cluster game or a skills based game (e.g., where payouts are based on poker hands).

FIGS. 16A and 16B represent an example game where symbols that make up a winning combination are removed and replaced with new symbols. In particular, winning symbols within the special region, highlighted in grey, can be replaced with new symbols that can form part of a new outcome.

FIG. 16A represents an example of a first reel spin outcome. This first outcome would be evaluated and paid to the player as a payout. Following the payout, the symbols within the special region that are included in the win, Pic 1 and the Queens in the example of FIG. 16A, those symbols are removed and new symbols would replace them. Once the new symbols have been substituted, the outcome would be evaluated and paid. This would continue until no win is found among the reel symbols within the special region.

New symbols can provide payout enhancements, such as a multiplier to a designated symbol (e.g., a wild). The multiplier could be the same for each evaluation, or could change with each subsequent substitution. In an example, the multiplier can rise incrementally following each evaluation, starting at ×1, and increasing by ×1 each time the symbols are replaced. Thus, a first substitution might result in a wild without a multiplier, whereas a second substitution could reveal a wild with a ×2 multiplier, etc. As the substitutions continue, the player would anticipate a continued string of subsequent wins with an increasing multiplier following each evaluation.

As shown in the figures, the Pic 1 and the Queens are part of the win in FIG. 16A. Thus, FIG. 16B shows those symbols replaced, resulting in yet another win that includes the two Kings and a wild with a ×2. This process would repeat until there are no symbols in the special region that form a win.

In the example of FIGS. 17A and 17B, a player is able to select one or more symbols for removal. The removed symbols would be replaced in one or more ways. For example, a symbol occupying the reel position immediately above the removed symbol can drop down to fill the location, or a new symbol can be introduced, either randomly or by a predetermined order. In another example, a user input can determine from which direction the symbol is replaced. For instance, in FIG. 17A, the player can select the Jack within the special region for removal, yet indicated that the replacement symbol should come from the left position, such as swiping across a touchscreen. In each instance, following a symbol replacement, a new evaluation is performed to determine a game outcome and potential payout award.

Following the examples of FIGS. 17A and 17B, the player decided which, if any, symbols within the special region to remove following a spin. As Pic 1 and the Queens within the special region are part of wins, the Jack is selected for removal in FIG. 17B. Once the Jack is removed, the Pic 1 and Queen on reel three move down to fill the empty spot and a new symbol is added to the top of reel three. As the newly added spot is within the special region and a wild, a multiplier can be applied. This feature, which allows players to interact with the game as well as experiencing gameplay with the element of chance, adds an element of skill that further enhances the player experience.

Figure 18A:
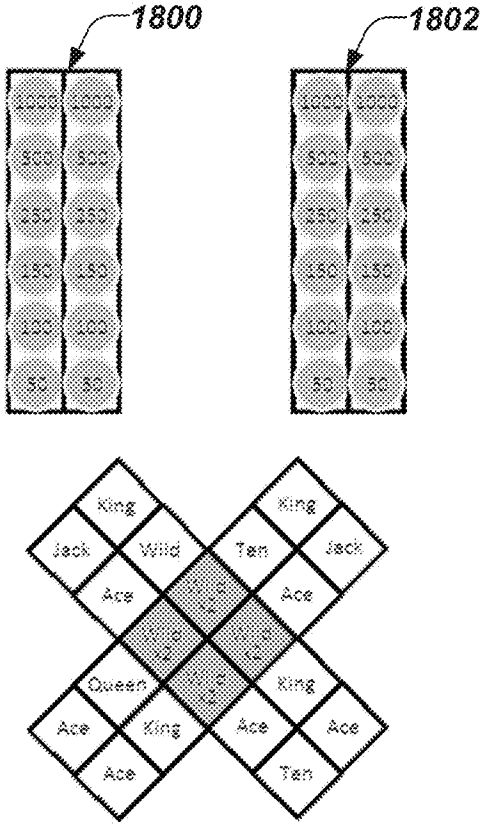
FIGS. 18A-18E illustrate example reel games where symbols of play or credit "cascade" into an empty reel position below.

FIGS. 18A-18D represent an example reel power game where one or both symbols of play or credit "cascade" into an empty reel position below. As shown, the reels form an X-shape, similar to FIGS. 3-5, however other geometries are considered. As shown in FIG. 18A, two silos of credits, 1800 and 1802, are provided. As shown, the silos are aligned so as to allow the credit symbols to "flow" into the reels (see, e.g., FIG. 18D).

Figure 18B:
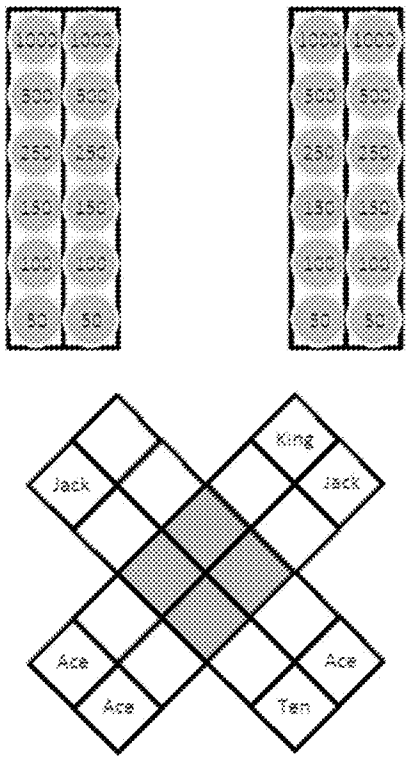
Figure 18C:
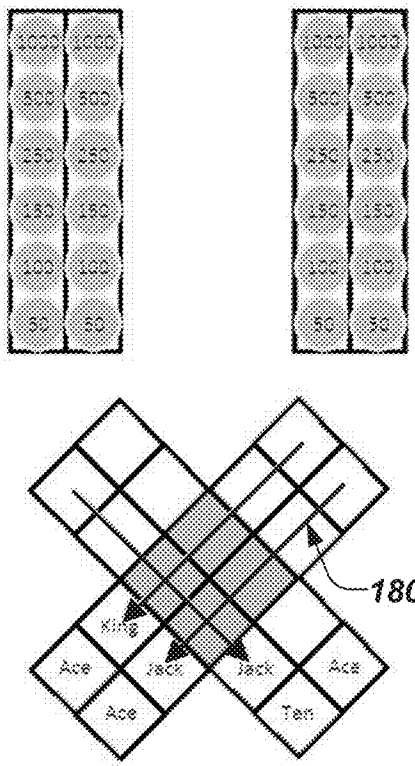
Figure 18D:
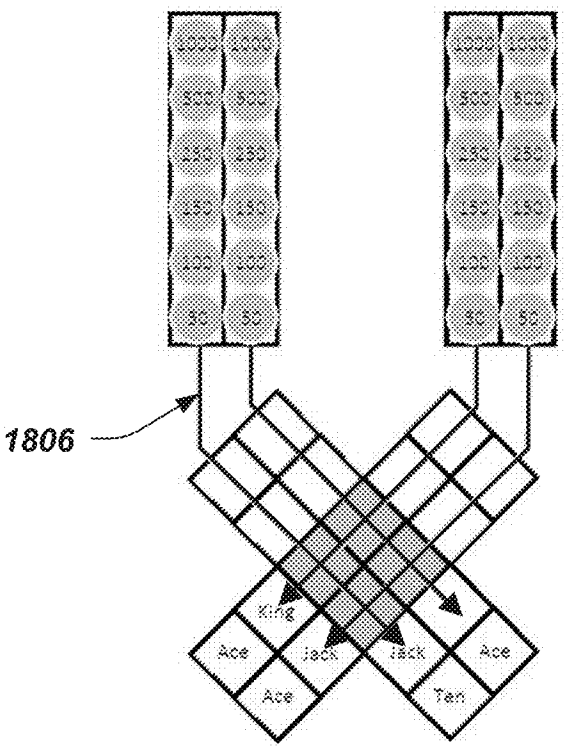

In some examples, each reel position will spin, as described with respect to FIGS. 3-5. Once the reels stop, the outcome is evaluated. In the example of FIG. 18B, the symbols that are part of the win are removed. The remaining symbols will then cascade downward, as shown by arrows 1804. Thus, the Jack in the upper left-hand reel position will cascade toward the Ten in the bottom right hand reel position. Further, the King and the Jack in the upper right hand reel positions cascade to the bottom left reel position near the pair of Aces.

Once the remaining symbols are in place, the credit symbols flow into the reel positions following arrows 1806. As shown, the credit symbols with the highest value are at the top. Thus, the player anticipates emptying the reel positions sufficient to allow the greatest number of credit symbols to flow into the reel positions.

Figure 18E:
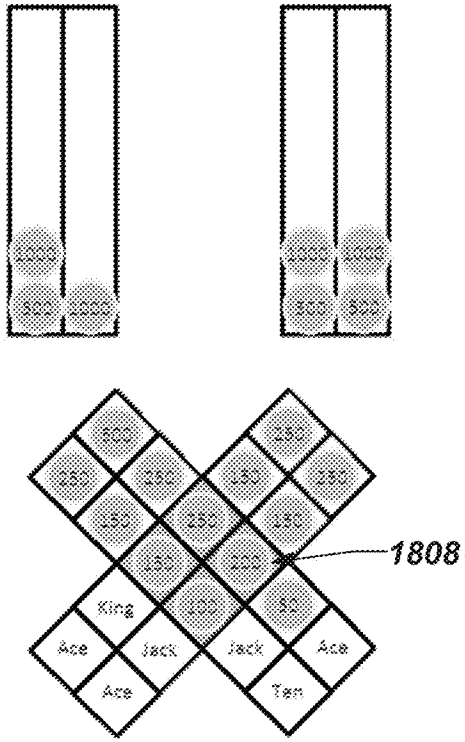

In some examples, credit symbols that overlap will combine in value. As shown in FIG. 18E, there is overlap in the middle four reel positions (i.e. the special region). Therefore, the amounts of the credit symbols that fall into those positions are combined. For example, two credit symbols with a 100 unit value will fall into the reel position 1808. Thus, the resulting value as the reel is evaluated provides a value of 200 to reflect each 100 unit credit symbol.

Figure 19A:
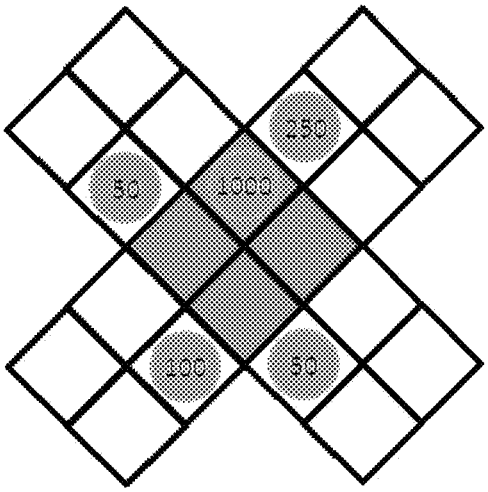
FIGS. 19A and 19B illustrate example reel games executed on an X-shaped reel.
Figure 19B:
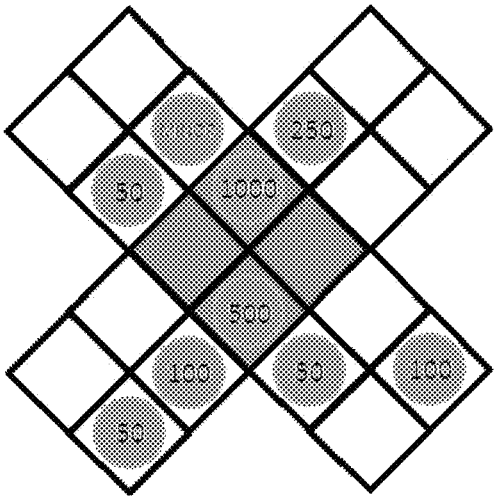

FIGS. 19A and 19B represent an example Reel Power Game executed on an X-shaped reel. In the game illustrated in FIGS. 19A and 19B, each diamond position is an individual reel (spins by itself). As the reels stop, the reel position is either blank or represented by a symbol (e.g., credit symbols, in the example of FIGS. 19A and 19B). Each credit symbol is assigned an amount. However, the amounts assigned to credit symbols that land in the special region, highlighted in grey, is increased. For example, one or more multipliers can be applied to one or more of the reel positions that are included in the special region. Further, credit symbols from a first or base spin, as shown in FIG. 19A, are locked into the reel position for each successive spin.

Thus, with each spin, the number of credit symbols on the reel increases, as shown in FIG. 19B. The number of spins available for each game can be determined at random, based on a wager (e.g., amount or additional wager), predetermined, or in response to one or more features of the game (e.g., if a certain value is present in the combined credit symbols, if a certain number of credit symbols occupy the special region, etc.). The objective is to have as many circles as possible occupying the reel. After the final spin, the amounts on the displayed credit symbols are calculated and provided as a payout.

Figure 20A:
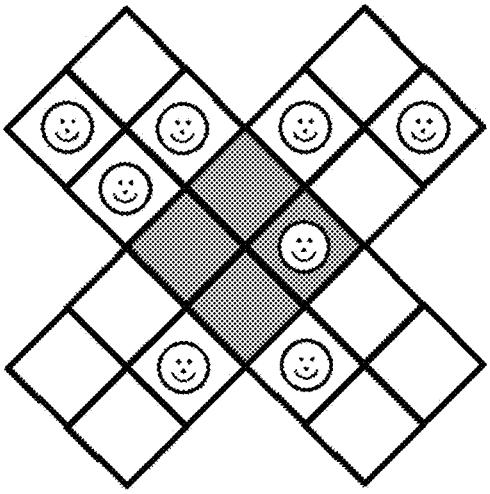
FIGS. 20A-20C illustrate example reel games where a type of symbol and/or relative position of symbols to one another determine the outcome of the game.
Figure 20B:
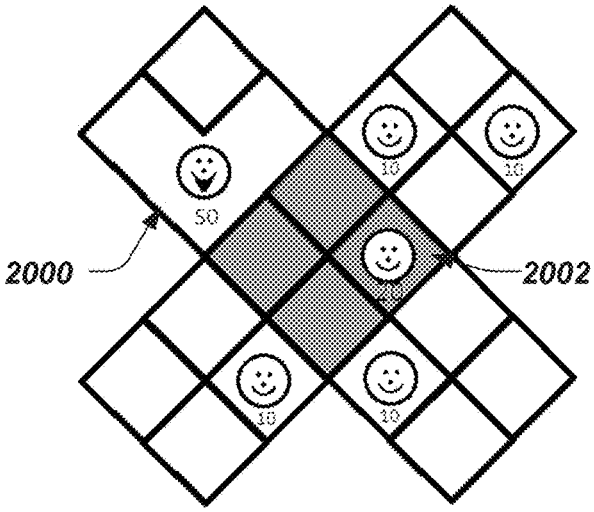

FIGS. 20A and 20B represent another example reel power game where a type of symbol and/or relative position of symbols to one another determine the outcome of the game. For example, an X-shaped reel where each diamond position is an individual reel (similar to the example of FIGS. 19A and 19B). As the reels stop, the reel position is either blank or represented by a symbol (e.g., a smiley face, in the example of FIGS. 20A-20C). FIG. 20A shows a reel following a first spin. After evaluation of the spin, an amount associated with each symbol is displayed. The amount increases as the number of adjacent smiley faces increases. Thus, in the upper right-hand reel 2000 of FIG. 20B, where three symbols were adjacent to one another, a new symbol has replaced the previous three, and the amount associated with the new symbol has raised accordingly. Furthermore, a symbol within the special region 2002 will be assigned an increased value, as described herein. After evaluation and assignment of representative values, the symbols will lock in their respective reel positions for a subsequent spin.

Figure 20C:
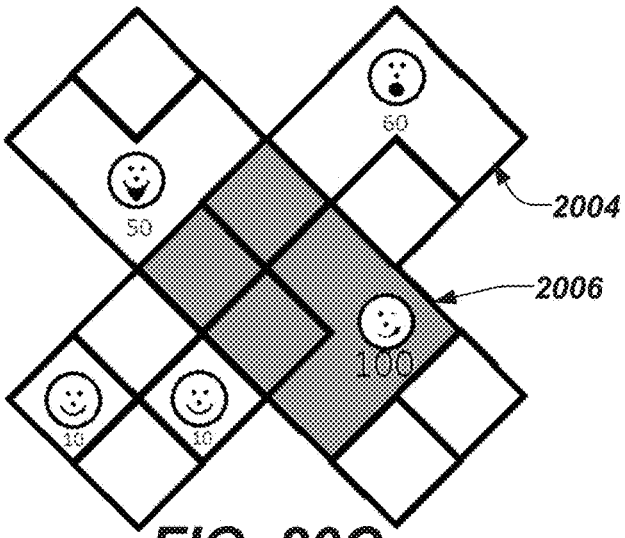

As shown in FIG. 20C, a subsequent spin can introduce a number of symbols, such that the symbols of a common or predetermined type located adjacent to the symbol in the special region 2002 combine to form a single, new symbol with an increased amount. Thus, different symbols can represent different amounts as well. Further, a number of reel positions can combine to form new regions, such as regions 2004 and 2006, which, each having yet another amount assigned to it, present yet two more symbols. In this manner, the player is able to identify the various groupings of symbols and/or amounts associated with the outcome. Therefore, clustering a large number of symbols increases the payout award.

Figure 21A:
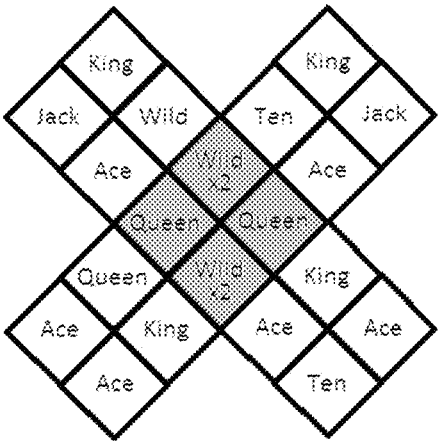
FIGS. 21A and 21B illustrate example reel games that employ poker symbols in an X-shaped reel to evaluate a winning play.
Figure 21B:
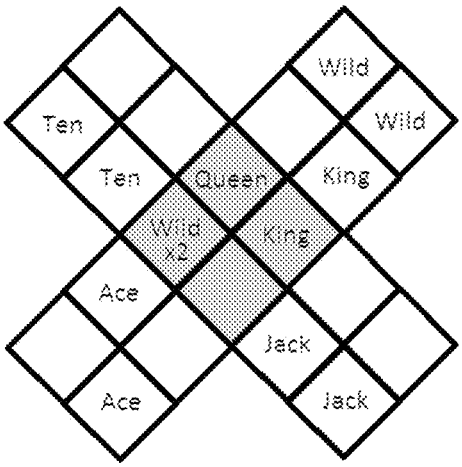

FIGS. 21A and 21B represent an example reel power game that employs poker symbols in an X-shaped reel to evaluate a winning play (e.g., more than four of a kind is possible). For this example game, each individual reel position can be wild, a poker symbol, or a blank. In the example of FIG. 21A, after a first or base spin, six Queens and 2 wilds can combine to make a winning combination, among others (e.g., Ace, King, Queen, Wild ×2, Ten, etc.).

In the example of FIG. 21B, several reel positions are blank. However, a straight (i.e. Ace, King, Wild ×2, Queen, Ten) and a four of a kind Kings will win on this spin. In some examples, reel positions can be exchanged, such as with different symbols to increase the winning hand, number of available wins, etc., based on a user input. Thus, an element of skill enhances the gameplay.

Figure 22A:
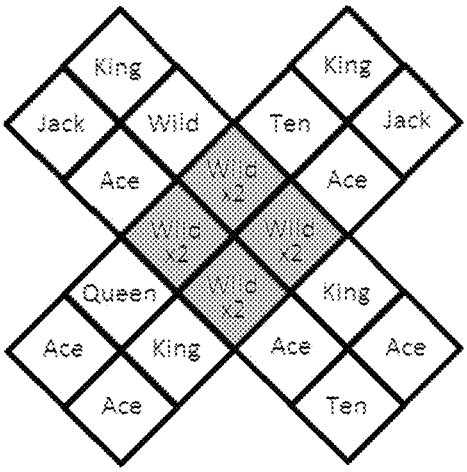
FIGS. 22A and 22B illustrate example reel games where like symbols can be combined to create a larger symbol with an increased value.
Figure 22B:
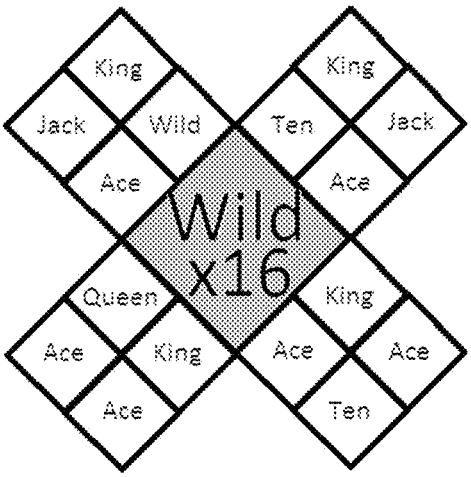

FIGS. 22A and 22B represent an example reel power game where like symbols can be combined to create a larger symbol with an increased value. As shown in FIG. 22A, the special region, highlighted in grey, includes four wild ×2. As shown in FIG. 22B, the four wilds are joined together to create a single wild with an increased multiplier. The result is a single reel position adjacent to a large number of other reel positions, where each win that includes the special region is multiplied ×16. Although a cluster of wilds within the special region is shown in this example, a similar grouping can be achieved with other symbols that are located outside of the special region or include one or more reel positions of the special region and one or more reel positions outside the special region (e.g., four adjacent Aces could cluster together to make a single Ace with an expanded border).

Figure 23A:
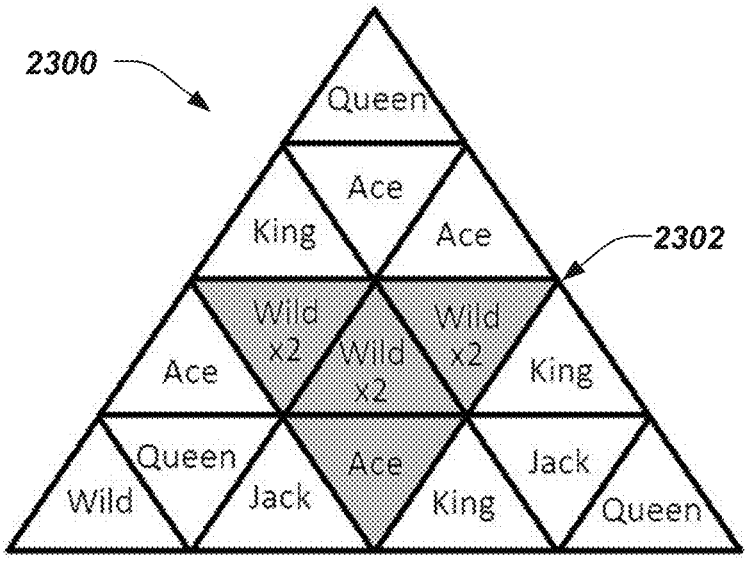
FIGS. 23A and 23B represent alternate example reel shapes.
Figure 23B:
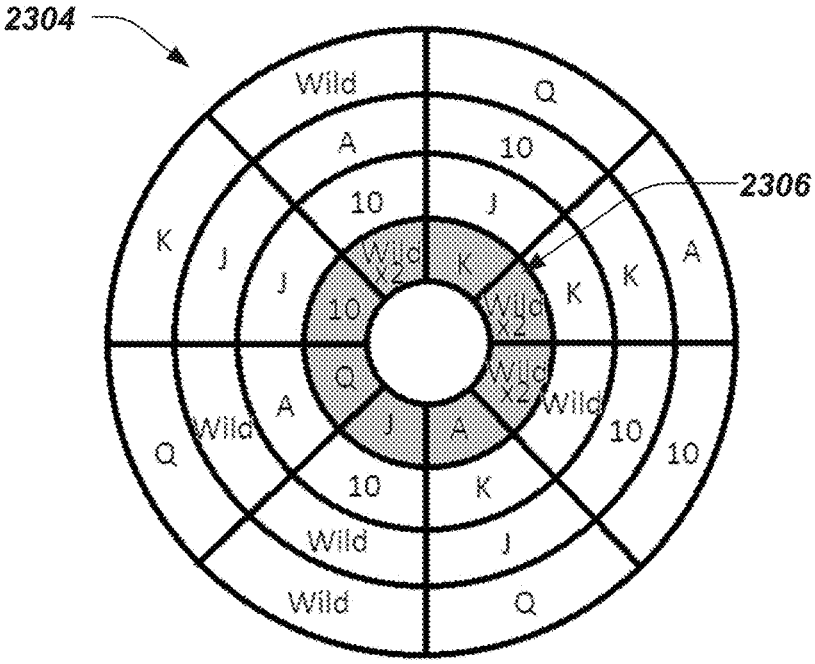

FIGS. 23A and 23B represent alternate example reel shapes in addition to those described above. For example, FIG. 23A illustrates a triangular reel shape 2300, with a centrally located special region 2302. FIG. 23B shows an annular shaped reel 2304, also with a centrally located special region 2306. In each example, the individual reels can spin independently, randomly, in succession, or any variety of ways to enhance the player experience. Moreover, although illustrated as centrally located, each special region 2302 and 2306 can be located at any region of the reel, occupying any number of individual reels, applying any variety of effects to the symbols that land in each reel position, in accordance with the examples described with respect to FIGS. 3-22. Further, although an X-shaped reel, a rectangular reel, a triangular reel, and an annular reel have been provided in the figures, any geometric configuration is considered, including, but not limited to, a circle, a square, a cross (e.g., T-shape), a combination of geometric shapes, as well as shapes with perspective (e.g., 3D) all can be provided within the spirit of the subject disclosure.

Figure 24:
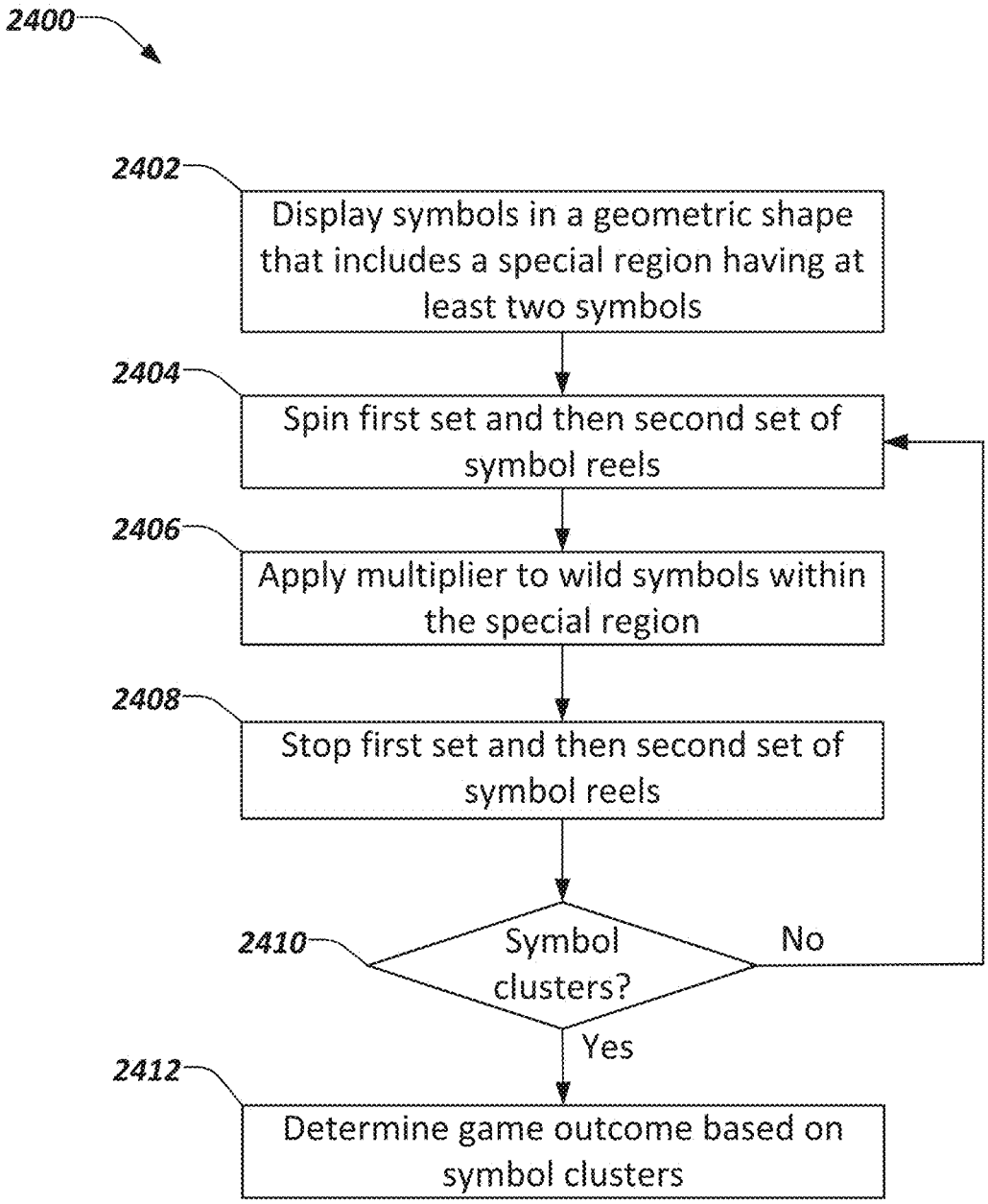
FIG. 24 is an example flowchart for a method of playing an interactive electronic gaming machine configured to receive and interpret an input from a user to implement a reel game that includes a special region.

FIG. 24 illustrates a method 2400 of playing an interactive electronic gaming machine configured to receive and interpret an input from a user to implement a reel game that includes a special region, consistent with the examples provided herein. The method 2400 can be executed as instructions or algorithms, stored on a memory device (e.g., memory 208), and executed via the game controller 200 (e.g., via one or more processors 204), as provided with respect to FIG. 2.

In block 2402, a plurality of symbol display positions (e.g., display positions 302) configured in a geometric shape (e.g., in the shape of an "X") are displayed via a display (e.g., main display 128), the display comprising a special region (e.g., special region 306) that includes two or more symbol display positions. This can occur in response to an item to establish a credit balance being received via a credit input or credit input mechanism (e.g., player tracking card reader 144, bill validators 124, 234, electronic payment system, display and/or information components 142, etc.), the credit balance being increasable and decreasable based at least on wagering activity.

In block 2404, a plurality of symbol reels at the symbol display positions are set spinning by a game controller. For example, the plurality of symbol reels can include a first set of symbol reels configured to spin in a first direction (e.g., direction 400) and a second set of symbol reels configured to spin in a second direction (e.g., direction 402) different from the first direction. In examples, the first and second direction including top to bottom, bottom to top, left to right, right to left, inward to outward, or outward to inward, as shown in FIG. 4A-F.

In block 2406, a multiplier is assigned to a symbol (e.g., a wild) within symbol display positions of the special region. In block 2408, the first set of symbol reels and then the second set of symbol reels are stopped, such as by the game controller. In block 2410, it is determined whether the symbols are located in clusters within the symbol display positions (see, e.g., FIG. 5B).

If no clusters of symbols are found, the process returns to block 2404 to evaluate a new spin. If a cluster is determined, the process continues to block 2412, where a game outcome is determined. Based on the game outcome, a payout associated with the cluster can be caused, such as by a payout system (e.g., printer 126, ticket printer 222, electronic payment transfer, etc.).

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

The invention claimed is:

1. An interactive electronic gaming machine configured to receive and interpret an input from a user to implement a reel game that includes special regions, comprising:

a credit input configured to receive an item to establish a credit balance, the credit balance being increasable and decreasable based at least on wagering activity;

a display having a plurality of symbol display positions configured on the display in a geometric shape comprising a special region that includes two or more symbol display positions that are configured to assign a multiplier to one or more symbols within symbol display positions of the special region, wherein the plurality of symbol reels comprises a first set of symbol reels and a second set of symbol reels, the game controller is further configured to spin the first set of symbol reels in a different direction than the second set of symbol reels intended to provide a visually appealing presentation;

a plurality of symbol reels spinnable to display symbols at the symbol display positions;

a game controller operable in accord with the credit balance, the game controller configured to:

spin and stop the symbol reels in response to a user input;

change the special region from a first special region comprising a first subset of symbol display positions to a second special region comprising a second subset of symbol display positions different from the first subset in response to a triggering event; and determine like symbols located in clusters of the symbol display positions; and a payout system configured to cause a payout based on the clusters.

2. The interactive electronic gaming machine of claim 1, wherein the geometric shape comprises an X-shape, the first set of symbol reels are located at a central area of the X-shaped display corresponding to the special region, and the second set of symbol reels are located outside the central area, the game controller further configured to stop the first set of symbol reels before the second set of symbol reels.

3. The interactive electronic gaming machine of claim 1, wherein the game controller is further configured to:

determine a type of each symbol located within the special region; and assign the multiplier to symbols of a predetermined type located within the special region.

4. The interactive electronic gaming machine of claim 1, wherein the game controller is further configured to display the first and second special regions on the display simultaneously.

5. The interactive electronic gaming machine of claim 1, wherein the first special region provides a first multiplier to a wild symbol and the second special region provides a second multiplier to the wild symbol.

6. The interactive electronic gaming machine of claim 5, wherein the first and second special regions overlap, the game controller configured to combine the first multiplier with the second multiplier to wilds that occupy symbol display positions in both the first and second special regions.

7. The interactive electronic gaming machine of claim 1, wherein the symbol reels are configured to spin in a plurality of directions including top to bottom, bottom to top, left to right, right to left, inward to outward, or outward to inward.

8. The interactive electronic gaming machine of claim 7, wherein the display is a touchscreen display, the game controller further configured to receive a user input across the touchscreen display to determine a spin direction for one or more of the symbol reels.

9. The interactive electronic gaming machine of claim 1, wherein a plurality of adjacent symbol display positions within the special region comprise a first symbol type following stop of the symbol reels, the game controller further configured to change the plurality of adjacent symbol display positions into a combined symbol display position defined by borders of the plurality of adjacent symbol display positions, the combined symbol display position comprising the first symbol type.

10. The interactive electronic gaming machine of claim 9, wherein the game controller is further configured to assign a multiplier to the combined symbol display position based at least on a number of display positions comprising the plurality of adjacent symbol display positions.

11. The interactive electronic gaming machine of claim 1, wherein the symbols comprise one of a pictographic image, a credit value, or a playing card value.

12. An interactive electronic gaming machine configured to receive and interpret an input from a user to implement a reel game that includes special regions comprising:

a credit input configured to receive an item to establish a credit balance, the credit balance being increasable and decreasable based at least on wagering activity;

a display having a plurality of symbol display positions configured on the display in a geometric shape comprising a special region that includes two or more symbol display positions that are configured to assign a multiplier to one or more symbols within symbol display positions of the special region; wherein the geometric shape comprises an X-shape, the first set of symbol reels are located at a central area of the X-shaped display corresponding to a special region, and the second set of symbol reels are located outside the central area, the game controller further configured to stop the first set of symbol reels before the second set of symbol reels;

a plurality of symbol reels spinnable to display symbols at the symbol display positions;

a game controller operable in accord with the credit balance, the game controller configured to:

spin a first set of symbol reels in a different direction than spinning of a second set of symbol reels in response to a user input intended to provide a visually appealing presentation;

stop the symbol reels by stopping the first set of symbol reels before the second set of symbol reels; and determine the symbols located in clusters of the symbol display positions, and wherein the game controller; and a payout system configured to cause a payout associated with a game win.

13. The interactive electronic gaming machine of claim 12, wherein the game controller is further configured to display a first special region in response to a first triggering event, and display a second special region in response to a second triggering event, wherein the first and second triggering events comprise a new spin, an increased wager, or a bonus play.

14. The interactive electronic gaming machine of claim 12, wherein one or more symbol reels of the plurality of symbol reels within a special region comprises a swappable symbol configured to be swapped in response to a user input, the game controller further configured to:

replace the swappable symbol with a different symbol in response to the user input; and adjust an amount of the payout based on the different symbol.

15. A method of employing an interactive electronic gaming machine configured to receive and interpret an input from a user to implement a reel game that includes a special region, the method comprising:

receiving, via a credit input, an item to establish a credit balance, the credit balance being increasable and decreasable based at least on wagering activity;

displaying, via a display, a plurality of symbol display positions configured in a geometric shape comprising a special region that includes two or more symbol display positions;

receiving a user input corresponding to a maximum wager;

converting all available reel positions to the special region in response to the maximum wager;

assigning a multiplier to symbols within symbol display positions of the special region;

spinning, by a game controller, a plurality of symbol reels at the symbol display positions, wherein the plurality of symbol reels comprises a first set of symbol reels configured to spin in a first direction and a second set of symbol reels configured to spin in a second direction different from the first direction intended to provide a visually appealing presentation, the first and second direction including top to bottom, bottom to top, left to right, right to left, inward to outward, or outward to inward;

stopping, by the game controller, the first set of symbol reels and then the second set of symbol reels;

determining, by the game controller, symbols located in clusters of the symbol display positions; and determining a game outcome to generate a payout associated with symbols located in clusters.

16. The method of employing an interactive electronic gaming machine of claim 15, further comprising:

collapsing the symbols located in clusters of the symbol display positions; and replacing the symbols located in clusters of the symbol display positions with different symbols.

* * * * *